United States Patent [19]

Potter

[11] 4,067,304

[45] Jan. 10, 1978

[54] FUEL PUMPING APPARATUS

[75] Inventor: James Charles Potter, London, England

[73] Assignee: Lucas Industries Limited, Birmingham, England

[21] Appl. No.: 746,348

[22] Filed: Dec. 1, 1976

[30] Foreign Application Priority Data

Dec. 6, 1975 United Kingdom ..... 50131/75

[51] Int. Cl.[2] ..... F02D 1/04

[52] U.S. Cl. ..... 123/140 MP; 123/140 FG; 123/179 L; 417/462

[58] Field of Search ..... 123/140 MP, 139 AC, 123/139 ST, 179 L, 140 FG; 417/462, 218, 221

[56] References Cited

U.S. PATENT DOCUMENTS

| | | | |
|---|---|---|---|
| 2,771,066 | 11/1956 | Bischoff | 123/140 FG |
| 3,676,023 | 7/1972 | Andrvsenko et al. | 417/462 |
| 3,797,469 | 3/1974 | Kobayashi et al. | 123/139 E |
| 3,861,833 | 1/1975 | Salzgeber et al. | 417/462 |
| 3,883,270 | 5/1975 | Baxter | 417/221 |

FOREIGN PATENT DOCUMENTS

| | | | |
|---|---|---|---|
| 1,393,897 | 5/1975 | United Kingdom | 417/462 |

*Primary Examiner*—Charles J. Myhre
*Assistant Examiner*—R. A. Nelli

[57] ABSTRACT

A fuel pump includes a member movable angularly to determine three fuel settings when the pump is used to supply fuel to a supercharged internal combustion engine. The member is moved by a fluid pressure operable means which includes a piston connected to the further member by a pin and a sleeve in which the piston is mounted and which itself is slidable within a cylinder. Fluid under pressure can be admitted to the cylinder by way of a valve, the pressure of fluid depending upon the speed at which the apparatus is driven. A spring is provided to bias the piston and sleeve so that the further member assumes a first position. When fluid pressure is applied the sleeve and piston move the further member to a second position after which further movement of the sleeve is halted so that the pressure in the cylinder must rise appreciably before the piston alone can move the further member to its third position.

17 Claims, 5 Drawing Figures

FIG.2.
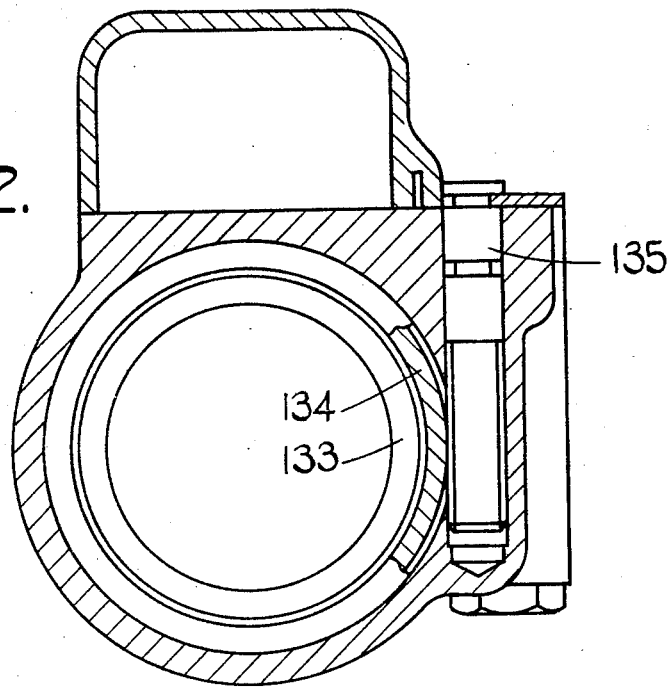
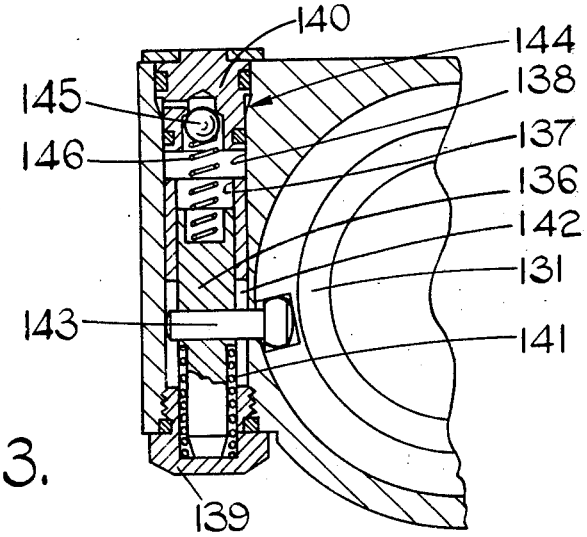
FIG.3.

FUEL PUMPING APPARATUS

This invention relates to fuel pumping apparatus for supplying fuel to internal combustion engines and of the kind comprising a pumping plunger movable inwardly within a bore to displace fuel from the bore to a fuel outlet, pump means for supplying fuel to the bore to urge the plunger outwardly, valve means for controlling the output pressure of said pump means so that it varies in accordance with the speed at which the apparatus is driven, control means operable to control the amount of fuel supplied to the bore, a cam for effecting inward movement of the plunger and stop means operable to determine the maximum outward movement of the plunger thereby to limit the maximum amount of fuel which can flow through said outlet irrespective of the setting of said control means.

With a super-charged engine the degree of supercharging is usually very low at low engine speeds and this is particularly the case with a turbocharged engine in which the compressor of the supercharger is driven by a turbine powered by the exhaust gases from the engine. At low engine speeds therefore the maximum amount of fuel which can be supplied to the engine is lower than that which can be supplied when the engine speed has increased to a level at which the supercharger is operating in an effective manner. It is still necessary to ensure that an excess of fuel can be obtained for starting purposes and the object of the present invention is to provide an apparatus of the kind specified in a form in which two levels of maximum fuel can be obtained together with excess fuel for engine starting purposes.

According to the invention in an apparatus of the kind specified said stop means comprises a stop member movable to determine the outward movement of the plunger, a further member movable between three positions and co-operating with said stop member so that in the first of said positions excess of fuel may be supplied by the apparatus, in the second of said positions the maximum amount of fuel for low engine speeds may be supplied by the apparatus and in the third of said positions the maximum amount of fuel for higher engine speeds may be supplied by the apparatus, said apparatus including fluid pressure operable means for moving said further member between said three positions, said fluid pressure operable means being responsive to the output pressure of said pump means.

According to a further feature of the invention said fluid pressure operable means comprises first fluid pressure operable member operatively connected to said further member and capable of moving said further member from said second to said third position, a second fluid pressure operable member having limited movement and capable in conjunction with said first operable member of moving said further member from said first to said second position and valve means through which fluid pressure is applied to said first and second fluid pressure operable members.

One example of a fuel pumping in accordance with the invention will now be described with reference to the accompanying drawings in which:

FIG. 2 is a cross section through one part of the apparatus with parts removed for the sake of clarity, FIG. 3 is a view similar to FIG. 2 taken at another axial position.

Figure 1:
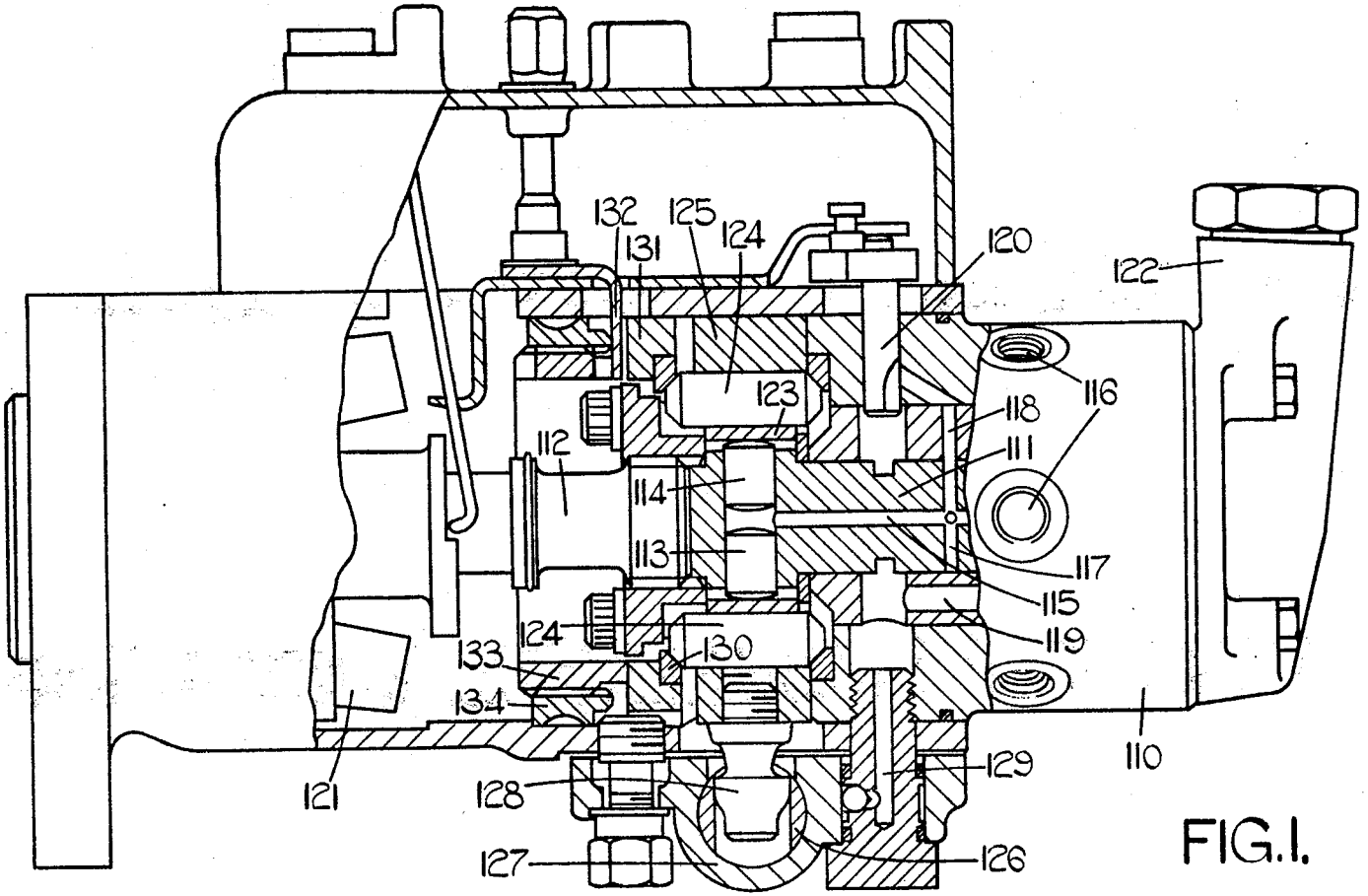
FIG. 1 is a part sectional side elevation of the apparatus.

Referring to the drawings the apparatus comprises a housing 110 in which is located a rotary cylindrical distributor member 111 which is coupled to a drive shaft 112 extending from the housing and adapted to be driven in timed relationship with a supercharged engine with which in use, the apparatus is associated.

Formed in the distributor member is a transversely extending bore 113 in which is mounted a pair of reciprocable pumping plungers 114. Communicating with the bore 113 is a passage 115 which at one point communicates with a radially disposed delivery passage (not shown) which is adapted to register in turn as the distributor member rotates, with a plurality of outlet ports 116 formed in the housing. The outlet ports in use are connected to fuel injection nozzles disposed to direct fuel into the combustion spaces respectively of the associated engine.

At another point the passage 115 communicates with radially disposed inlet passages 117 which are able to register in turn as the distributor member rotates, with an inlet port 118 formed in the housing. The inlet port 118 communicates with a supply passage 119 by way of an angularly adjustable throttle member 120 and when the inlet port communicates with a passage 117 fuel will flow from the supply passage 119 to the bore 113. The amount of fuel which can flow when such communication is established, depends on the setting of the throttle member 120. In known manner the setting of the throttle member 120 is controlled by a governor mechanism which includes a plurality of weights 121 movable outwardly to decrease the amount of fuel supplied, the weights moving in opposition to a governor spring (not shown) the force exerted by which can be adjusted by means of an operator adjustable member (not shown).

The supply passage 119 communicates with the outlet of a feed pump positioned in the housing and having a rotary part which is driven from the end of the distributor member. The feed pump draws fuel from an inlet 122 and a valve is provided which controls the outlet pressure of the feed pump so that it varies in a manner depending upon the speed at which the apparatus and therefore the associated engine is operating.

At their outer ends the plungers 114 contact shoes 123 which support rollers 124 respectively. The rollers 124 engage with the internal peripheral surface of a cam ring 125 which is angularly adjustable within the housing. The cam ring has on its internal peripheral surface, a plurality of pairs of cam lobes. The rollers 124 and the shoes 123 rotate with the distributor member 111 and as the rollers engage the cam lobes inward movement will be imparted to the plungers. During this movement fuel is displaced from the bore 113 and flows by way of the passage 115 to one of the outlet ports 116. When the rollers 124 move over the cam lobes the plungers 114 can move outwardly under the action of fuel which is supplied by way of the inlet port 118, the fuel flowing to the passage 118 by way of one of the inlet passages 117.

The angular setting of the cam ring 125 is adjustable in known manner, by means of a fluid pressure operable piston 126 which is contained within a housing 127. The piston is connected by means of a peg 128 to the cam ring and fuel under pressure from the outlet of the feed pump is applied to the piston 126 by way of a passage 129 which communicates with the passage 119.

In order to control the quantity of smoke in the exhaust system of the engine it is necessary to limit the maximum amount of fuel which can be supplied by the apparatus during running of the engine but it is also necessary to allow the apparatus to provide an additional or excess quantity of fuel to enable the associated engine to be started particularly when it is cold. Stop means is therefore provided to control the permitted outward movement of the rollers 124 and thereby the shoes 123 and the plungers 114.

As has been stated where the apparatus is intended to supply fuel to a supercharged engine the characteristics of the supercharger must be taken into account. It is well known that at low engine speeds the super charger particularly if it is of the type in which the compressor is driven by a turbine which is powered by the exhaust gases of the engine, is relatively ineffective to provide any degree of supercharging to the engine. At higher engine speeds however with an increased speed of rotation of the compressor, the degree of supercharging increases and in some cases it is necessary to limit the degree of supercharging provided. At low engine speeds therefore the engine can be regarded as being a "naturally aspirated" engine but as the engine speed increases and the supercharger becomes effective, then the engine can no longer be regarded as a "naturally aspirated" engine. When an engine is supercharged it can be allowed a higher maximum quantity of fuel than in the case when it is naturally aspirated, without exeeding the limit of exhaust smoke and therefore any apparatus for supplying fuel to a supercharged engine must for normal running of the engine be able to provide at least two maximum fuel settings. With the additional requirement of excess fuel there must in effect be three maximum fuel settings.

Referring again to the drawings, the end portions of the rollers 124 are tapered and mounted on opposite sides of the rollers are a pair of stop rings 130. The stop rings are positioned outwardly of the rollers and are shaped for engagement with the end portions of the rollers. As shown in FIG. 1 of the drawings the right-hand stop ring is fixed within the body of the apparatus however, the left-hand stop ring is set into an annular member 131. The annular member 131 is angularly adjustable between three positions, as will be described.

The face of the annular member 131 remote from the rollers is engaged by the end face of a ring member 133 and this is secured against angular movement within the housing by means of a stop 132 engageable within a slot defined within the ring member. The peripheral surface of the ring member 133 is provided with a screw thread which is in engagement with a complimentary screw thread formed on the internal periphery of a further ring member 134 and the outer peripheral surface of the further ring member is provided with gear teeth engageable with a worm adjustor 135. The angular setting of the adjustor may be determined from exterior of the housing. As the adjustor is rotated the further ring member 134 will partake of angular movement and by virtue of the screw thread connection between the ring members 133 and 134, the ring member 133 will move axially. Such axial movement will be imparted to the annular member 131 and by this arrangement the amount by which the rollers 124 can move outwardly can be determined. For practical purposes the adjustor 135 will be pre-set when the pump is assembled but it may be re-set as and when required.

Figure 4:
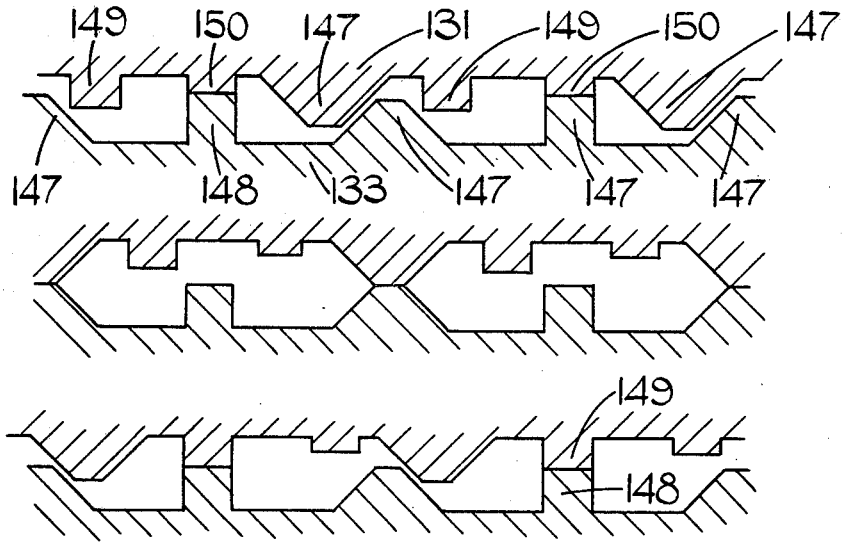
FIG. 4 is a developed view of two co-operating ring members showing the members in three positions and FIG. 5 is a view similar to FIG. 3 showing a modification.

The ring member 131 as previously stated is movable between three positions. The first such position is the position in which excess fuel is obtained for starting purposes, the second such position is for low speed engine operation where the engine can be regarded as being "naturally aspirated" and the third such position is for higher engine speeds where the supercharger is effective. In a particular example the stroke of the pumping plungers is 1.3mm for low engine speed rising to 1.6mm for the higher engine speeds where the supercharger is effective, and 2.4mm for the purpose of providing excess fuel. The three positions of the annular member 131 are illustrated in FIG. 4. In the upper view of this figure the annular member 131 is in the first position, the second position being shown below and the third position being the bottom view. Before discussing the engaging profiles of the annular member 131 and the ring member 133, reference will be made to FIG. 3 which illustrates a fluid pressure operable device for obtaining the three settings of the annular member 131.

With reference to FIG. 3 a first fluid pressure operable member in the form of a piston 136 is provided and this is slidable within a second fluid pressure operable member 137 in the form of a sleeve which surrounds the piston. The sleeve 137 is slidable within a cylinder 138 which is formed in the housing. One end of the cylinder is closed by an end cap 139 and the other end of the cylinder is closed by a further end cap 140. Positioned between the piston 136 and the end cap 139 is a coiled compression spring 141. Moreover, the sleeve 137 is provided with a pair of diametrically opposed slots 142 and extending through the slots is a peg 143 which is mounted on the piston and which extends at right angles to the axis of movement thereof. The peg 143 has a head which engages within a recess formed in the annular member 131 whereby as the piston 136 moves, angular movement will be imparted to the annular member. The annular member 131 is shown in FIG. 3, in the aforesaid third position.

Fuel under pressure is supplied to the cylinder 138 from the passage 119 by way of a pre-loaded valve 144 and which is located in the end cap 140. The valve 144 includes a seating defined in the end cap and a bore 145 for co-operation with the seating to control the flow of fuel into the cylinder from the outlet of the feed pump. The bore is biased into contact with the seating by means of a coiled compression spring 146 which is disposed intermediate the bore and the piston 136.

When the apparatus is at rest the piston 136 will be moved by the spring 141 into contact with the end cap 140. Moreover, the peg 143 will engage with the base portions of the slots in the sleeve 137 and will urge this into contact with the end cap 140. With the piston and sleeve in this position the annular member 131 will be in the aforesaid first position. Thus excess fuel will be supplied to the engine providing the throttle member 121 is fully open. As the engine speed increases the output pressure of the feed pump will also increase however, the ball 145 is held in firm contact with the seating by means of the spring 146. At some point however the ball will be lifted from its seating and fuel under pressure will flow into the cylinder 138. The fuel pressure will act on both the piston and the sleeve thus causing these two components to move together against the action of the spring 141. Such movement continues until the sleeve 137 engages the end cap 139. In this position the annular member 131 is in the aforesaid second position. Moreover, because the piston 136 has moved the force exerted on the ball 145 by the spring 146 is reduced so that even if the engine speed starts to fall the ball 145 will still remain lifted from its seating. By virtue of this arrangement therefore once the engine has started and the annular member has been moved to the aforesaid second position then excess fuel will no longer be provided even if the engine speed falls to a valve below that at which the piston and sleeve moved were initially moved.

When the sleeve 137 contacts the end cap 139 it can no longer assist the piston in its movement against the spring 141. Therefore movement of the annular member 131 from the second to the third position is effected only by the force which is exerted on the piston 136. There will therefore be required an appreciable increase in engine speed before the piston 136 is able to move the annular member 131 to the third position in which it is shown in FIG. 3 of the drawings. In a particular example the movement of the annular member 131 from the first to the second position takes place at 500 r.p.m pump speed and the movement to the third position is completed by the time the pump speed has reached 700 r.p.m. As has been mentioned even if the pump speed falls below 500 r.p.m there will be no return to the first position.

Turning now o FIG. 4 it will be appreciated that the views shown therein are developed views of the annular member and the ring member. Both the annular member 131 and the ring member 133 are provided in their presented side faces, with equiangularly spaced projections 147. The projections have sloping side faces but have flattened upper faces and in the second position of the ring member 131 the flattened upper faces of the projections engage each other to determine the axial spacing between the member.

Intermediate the projections 147 the ring member 133 is provided with projections 148 which are of substantially square section and which have a height substantially equal to that of the projections 147. Moreover, intermediate adjacent pairs of projections 147 on the annular member 131 are two projections from two series of projections 149, 150. The height of the projections 149, 150 is less than the height of the projections 147 and the height of the projections 150 is less than that of the projections 149. As seen in the upper figure of FIG. 4, the projections 150 are engaged with the projections 148 so that the annular member and the ring member are as close together as is possible. As the annular member 131 is moved angularly to the aforesaid second position the present sloping faces of the projections 147 move the annular member and the ring member apart to a distance determined by the height of the projections 147 and as the annular member is moved to the aforesaid third position the annular member and ring member move closer together until as seen in the lower figure of FIG. 4, the extent of separation is determined by the abutment of the projections 148 and 149.

By the arrangement described the apparatus can be used to supply fuel to a supercharged engine being able to determine the maximum fuel at low engine speeds when the supercharger is ineffective and at higher engine speeds when the supercharger is effective and also being able to provide an excess of fuel for starting purposes. It will be noted that no pressure tapping is employed through which the output pressure of the supercharger can be sensed. It is therefore necessary to ensure that the two springs and the areas of the sleeve and piston together with the output pressure be arranged so that there is no possibility of the engine being supplied at any speed within its working range, with more fuel than it is capable of burning without exceeding the allowed level of smoke in its exhaust.

When the engine is stopped leakage of fuel from the cylinder 138 allows the sleeve 137 and piston 136 to move under the action of the spring 141 to the position in which an excess of fuel is supplied for starting purposes. During this time the ball 145 is urged onto its seating and so the leakage is by way of the various working clearances. The slow leakage of fuel does mean that the return of the pump components to the excess fuel position is delayed and this can cause problems for example when the engine stalls after a cold start and the engine still requires excess fuel for restarting. This difficulty can be minimised by utilising the construction shown in FIG. 5.

Figure 5:
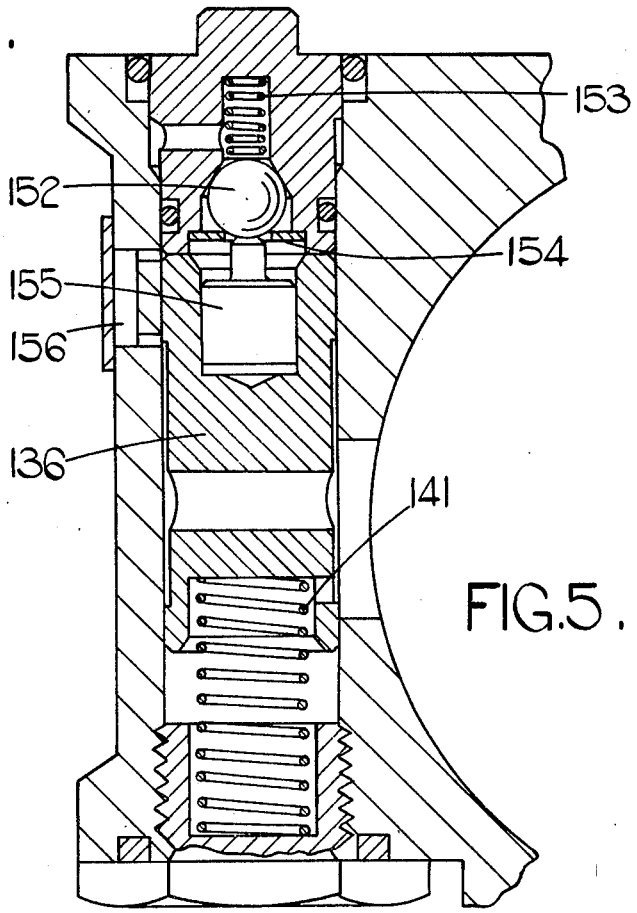

In FIG. 5 the ball valve 152 is biassed away from its seating by a light spring 153 the extent of movement of the ball valve being limited by a stop plate 154 having a non circular aperture therein. The piston 136 is provided in its end face presented to the ball valve with a recess in which is located a plug 155 having an end portion positioned to engage the ball valve 152. The piston as in the previous example is loaded by the spring 141 and for the sake of description the sleeve 137 is omitted.

In the rest position as shown the ball valve is held on its seating by the action of the spring 141 transmitted through the piston and plug. As the output pressure of the pump increases a valve of pressure will be attained at which the force acting on the ball valve overcomes the force exerted by the spring. This pressure will then be applied to the piston and the latter will then move against the action of the spring as described above. The differential effect is provided by the fact that the area of the piston subjected to the pressure is greater than the area of the ball valve subjected to the pressure. When the engine stops the output pressure falls and the ball valve being lifted from its seating, allows the piston to return quickly under the action of the spring. The final movement of the piston during which movement of the ball valve occurs, is assisted by a leakage path 156 which is opened to a groove on the piston, the groove communicating with a drain, as the piston engages the ball valve. As shown the leakage path comprises a pair of interconnected ports one of which is in constant communication with the space between the piston and the plug and the ohter of which is partly uncovered to the groove on the piston during the final movement of the piston. Said other port does allow a small leakage of fuel as the ball valve opens but this leakage is very small and occurs in practice for only a short period of time.

I claim:

1. A fuel pumping apparatus for supplying fuel to internal combustion engines and comprising a pumping plunger movable inwardly within a bore to displace fuel from the bore to a fuel outlet, pump means for supplying fuel to the bore to urge the plunger outwardly, valve means for controlling the output pressure of said pump means so that it varies in accordance with the speed at which the apparatus is driven, control means operable to control the amount of fuel supplied to the bore, a cam for effecting inward movement of the plunger, stop means operable to determine the maximum outward movement of the plunger thereby to limit the maximum amount of fuel which can flow through said outlet irrespective of the setting of said control means, said stop means comprising a stop member movable to determine the outward movement of the plunger, a further member movable between three positions and co-operating with said stop member so that in the first of said positions excess of fuel may be supplied by the apparatus, in the second of said positions the maximum amount of fuel for low engine speeds may be supplied by the apparatus and in the third of said positions the maximum amount of fuel for higher engine speeds may be supplied by the apparatus, said apparatus including fluid pressure operable means for moving said further member between said three positions, said fluid pressure operable means being responsive to the output pressure of said pump means.

2. An apparatus according to claim 1 in which said fluid pressure operable means comprises a first fluid pressure operable member operatively connected to said further member and capable of moving said further member from said second to said third position, a second fluid pressure operable member having limited movement and capable in conjunction with said first oper able member of moving said further member from said first to said second position and valve means through which fluid pressure is applied to said first and second fluid pressure operable members.

3. An apparatus according to claim 1 in which said further member and said stop member have opposed faces, said faces having projections thereon, different pair of said projection being engaged when the further member is in its alternative positions to determine the distance between said faces.

4. An apparatus according to claim 3 in which said further member and said stop member are each provided with a set of spaced first projections, the two sets of first projections being brought into engagement when said further member is in said second position, one of said members having a set of second projections alternately disposed relative to the first projections on said member, the other member having sets of third and fourth projections, one of said third projections and one of said fourth projections being disposed intermediate adjacent ones of said first projections, said third and fourth projections having differing heights whereby when said further member is in its first or third positions, the second projections will engage with the third or fourth projections.

5. An apparatus according to claim 4 in which said first projections have sloping side faces.

6. An apparatus according to claim 5 in which said further member and said stop member are of annular form, the projections forming said sets being equiangularly disposed about the presented side faces of said members.

7. An apparatus according to claim 6 including means for adjusting the axial setting of said further member.

8. An apparatus according to claim 7 in which said means is operable from exterior of the apparatus.

9. An apparatus according to claim 8 in which said fluid pressure operable means comprises a first fluid pressure operable member operatively connected to said further member and capable of moving said further member from said second to said third position, a second fluid pressure operable member having limited movement and capable in conjunction with said first operable member of moving said further member from said first to said second position and valve means through which fluid pressure is applied to said first and second fluid pressure operable members.

10. An apparatus according to claim 9 in which said valve means comprises a valve member which can cooperate with a seating to prevent the application of fluid pressure to said first and second fluid pressure operable members and resilient means operable to urge the valve member into contact with the seating, said resilient means acting between the valve member and said first fluid pressure operable member.

11. An apparatus according to claim 9 in which said valve means comprises a valve member which can cooperate with a seating to prevent the application of fluid pressure to said first and second fluid pressure operable members, resilient means for biasing said further member to said first position and abutment means carried by said first fluid pressure operable member which maintains said valve member in contact with the seating when said further member is in said first position, and further resilient means biasing said valve member to the open position.

12. An apparatus according to claim 10 in which said first fluid pressure operable member comprises a piston slidable within a sleeve constituting said second fluid pressure operable member and said sleeve being slidable within a cylinder one end of which is closed by a cap in which is formed a passage through which fluid under pressure flows to act on the piston and sleeve.

13. An apparatus according to claim 11 in which said valve means comprises a valve member which can cooperate with a seating to prevent the application of fluid pressure to said first and second fluid pressure operable members and resilient means operable to urge the valve member into contact with the seating,, said resilient means acting between the valve member and said first fluid pressure operable member.

14. An apparatus according to claim 12 including further resilient means acting between said piston and an end cap serving to close the other end of the cylinder.

15. An apparatus according to claim 13 in which said further member is of annular form and movable angularly between said first, second and third positions, the cylinder having its axis disposed tangentially relative to said further member and the piston mounting a peg extending laterally into engagement within a recess in said further member.

16. An apparatus according to claim 15 in which said sleeve is provided with a slot through which the portion of the pin extending between the piston and further member passes, said pin being engaged by the base wall of said slot during movement of the further member between the first and second positions, said sleeve engaging a portion of said second mentioned end cap to prevent it assisting the movement of said further member to said third position.

17. An apparatus according to claim 13 including a leakage path from the portion of the cylinder disposed between said first mentioned end cap and said piston, said leakage path being opened by said piston as the further member is moved by the resilient means to said first position.

* * * * *